United States Patent [19]

Brocklehurst

[11] Patent Number: 4,607,582

[45] Date of Patent: Aug. 26, 1986

[54] AUTOMATIC TOWEL ALIGNING, CUTTING AND HEMMING SYSTEM

[75] Inventor: Charles E. Brocklehurst, Fountain Inn, S.C.

[73] Assignee: Opelika Manufacturing Corporation, Chicago, Ill.

[21] Appl. No.: 621,935

[22] Filed: Jun. 18, 1984

[51] Int. Cl.[4] ..... D05B 27/12; D05B 25/00; B26D 5/00; B65H 23/16

[52] U.S. Cl. ..... 112/121.12; 83/367; 112/318; 226/34; 226/44

[58] Field of Search ..... 83/367; 112/141, 306, 112/311, 314, 318, 322, 121.12, 121.11; 226/34, 44, 10, 35

[56] References Cited

U.S. PATENT DOCUMENTS

| | | | |
|---|---|---|---|
| 695,553 | 3/1902 | Heany | 83/371 |
| 2,458,612 | 1/1949 | Luzzatto et al. . | |
| 2,693,235 | 11/1954 | Kenworthy et al. | 164/49 |
| 2,716,266 | 8/1955 | MacIsaac, Jr. et al. | 226/10 X |
| 2,966,086 | 12/1960 | Sjöstrom | 83/175 |
| 3,029,675 | 4/1962 | Alexander et al. | 83/371 X |
| 3,246,816 | 4/1966 | Dexter et al. | 83/371 X |
| 3,262,697 | 7/1966 | Krinke | 271/33 |
| 3,289,507 | 12/1966 | Grewe | 83/74 |
| 3,318,179 | 5/1967 | Elsas | 83/201 |
| 3,610,493 | 10/1971 | Brocklehurst | 226/17 |
| 3,612,513 | 10/1971 | Godlewski | 271/37 |
| 3,699,832 | 10/1972 | Smith et al. | 83/210 |
| 3,704,820 | 12/1972 | Frederick et al. | 226/34 |
| 3,707,255 | 12/1972 | Ridgway | 226/136 |
| 3,772,948 | 11/1973 | Burton | 83/23 |
| 3,933,350 | 1/1976 | Mignano | 271/10 |
| 3,948,125 | 4/1976 | Hujer et al. | 83/62 |
| 4,029,251 | 3/1976 | Johnson | 226/154 |
| 4,034,634 | 7/1977 | Arbter | 83/18 |
| 4,068,603 | 1/1978 | Arbter | 112/121 |
| 4,187,132 | 2/1980 | Dijk et al. | 226/10 X |
| 4,375,175 | 3/1983 | Elsas et al. | 83/18 |
| 4,397,205 | 8/1983 | Kirstein | 83/364 |
| 4,418,904 | 12/1983 | Fujimoto | 271/37 |
| 4,437,369 | 3/1984 | Brocklehurst et al. | 83/18 |
| 4,493,234 | 1/1985 | Ziegler et al. | 83/367 X |

FOREIGN PATENT DOCUMENTS

| | | | |
|---|---|---|---|
| 521436 | 3/1931 | Fed. Rep. of Germany | 112/322 |
| 2653790 | 6/1978 | Fed. Rep. of Germany | 83/367 |

OTHER PUBLICATIONS

Magetron S.R.L. Maechinsautomatiche Brochure 4 pages.

Indai Kindai Special Sewing Machines-Brochure.

*Primary Examiner*—Wm. Carter Reynolds

*Attorney, Agent, or Firm*—Thomas & Kennedy

[57] ABSTRACT

Terry cloth towel (18) moves from a supply along its length through an aligning and cutting system (14), to a transfer station (15). As the untufted bands (20) of the toweling material approach the transfer station, a plurality of fingers (28) of a gate (25) engage the untufted portion of the toweling, an as the toweling continues to move, the oncoming edge (22) of the plush surface (19) of the toweling engages and is retarded by the fingers. In the meantime, a plurality of presser feet (92) each of which is aligned with the fingers of the gate urge the toweling into engagement with a feed roller (85) that pulls the toweling through the processing path, and tension in the toweling tends to lift one or more of the presser feet (92) to relieve the pull applied to the toweling. This function is to straighten the band of the toweling. The toweling is then cut across its length with cutter (45), and the cut segment of towel in the transfer station (15) is then moved in a path parallel to its cut edges through a hemming station (16) where the cut edges are folded over and sewn by sewing machines (17).

14 Claims, 10 Drawing Figures

FIG. 2
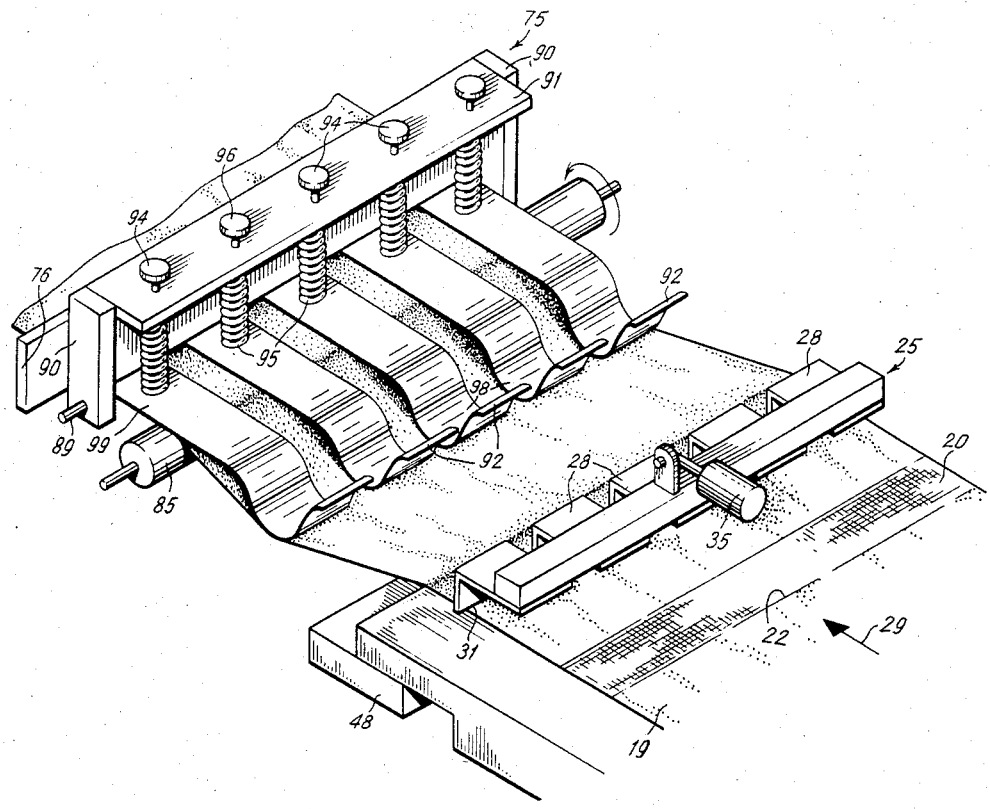
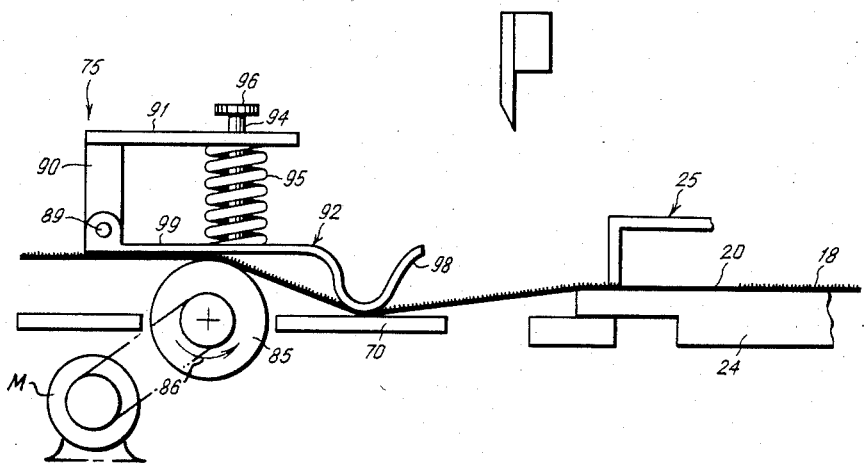
FIG. 3

AUTOMATIC TOWEL ALIGNING, CUTTING AND HEMMING SYSTEM

BACKGROUND OF THE INVENTION

This invention relates to a method and apparatus for automatically feeding sheet material such as terry cloth toweling along its length from a supply to a transfer station, cutting segments of the sheet material in the transfer station from the supply and then moving the cut segment of the sheet material in a path parallel to its cut ends and hemming the cut ends as the sheet material moves. More particularly, the invention comprises a method and apparatus for aligning the untufted laterally-extending bands of terry cloth toweling as the toweling is moved from a supply toward a cut and transfer station, in such a manner that the bands are straightened and accurate cuts are made through the bands, equidistant between the plush areas of the toweling.

In the manufacture of terry cloth towels and other flat goods, a common procedure is to move the toweling along its length from a supply and cut across its length to form the goods in segments. A popular design for terry cloth towels is to have the main body of the terry cloth towel include a plush surface of terry cloth, and then at the opposite ends of the towel to have several bands of lesser thickness and of different lengths adjacent a hem or fringe. The terry cloth toweling is initially manufactured in a very long length, and the supply of terry cloth towel material is advanced along this length and cut through the bands to form the individual towel segments.

In the past, terry cloth towel material has been cut by hand, by a worker moving the towel material along a work surface, locating the thin bands of the towel material, and then cutting through the bands. Typically, a motorized cutting implement is used which includes a rotatable cutting disk and the worker moves the implement along the thin bands of toweling material to cut the material. This is a slow operation, requires a skilled worker, and occasionally results in improper cuts being made in the toweling material.

Another prior art apparatus for cutting terry cloth toweling material through the thin bands extending laterally across the material includes an automated cutter wherein the supply of towel material is fed toward a cutting station between a pair of parallel rotatable rollers that engage the plush surfaces of the toweling to move the toweling to the cutter. The spacing of the rollers is greater than the thickness of the thin bands of the toweling material, so that the rotation of the rollers will not move the toweling material when the thinner bands are between the rollers. When a thin band of the toweling material is detected, the rollers are operated to run in the reverse direction and the rollers move the thick part of the toweling backwards along the feed path until the thin portion of the material is located between the feed rollers. This locates the thin portions of the material at the cutting station, and a cut is made across the material at a predetermined distance from the feed rollers. While this type of equipment functions to make a cut through the thin bands of the towel material, the equipment operates at a relatively low speed and the direction of movement of the toweling material must be reversed during each cutting cycle, and the equipment does not work well on relatively thin terry cloth material. Moreover, some terry cloth material is likely to have a pattern of several thin bands extending across the material so that the towel segment which is cut from the material will have a design at opposite ends of alternating long and short bands of thin material. It is difficult for some of the prior art automatic towel cutting equipment to distinguish between the long and short thin bands in the toweling material so as to make the cut in the long thin band and not in a short thin band.

Another prior art towel cutting device comprises a detecting system for locating bands formed in the terry cloth material that include no filler threads so that when a cut is made through these thin bands of a toweling material, a towel with a loose fringe is formed. The detection equipment includes a feeler that tends to fall through the areas of towel material that have no filler threads so as to locate the proper portion of a towel material where the cut is to be made. The detector tends to accumulate thread, lint, and debris and to become inoperable after the system has been operated for some period of time. Also, the detection system has not proven to be 100% reliable in that slack in one edge portion of the towel caused by nonuniform weaving of the material tends to cause an incorrect cut across the material.

Another prior art apparatus is disclosed in U.S. Pat. No. 4,375,175, wherein toweling material is advanced along its length to a cutting station and the thin bands of a toweling material are detected at opposite edges of the toweling material. The cutter is then angled so as to correspond with the angle of the thin band across the toweling material, the toweling material is streched taut across its length so as to tend to remove the curvature from the thin band, and then the cut is made at the angle of the thin band across the toweling material.

Another prior art apparatus is disclosed in U.S. Pat. No. 4,437,369 which discloses apparatus that advances toweling material along its length to a cutter. Detectors at opposite sides of the path of the toweling material detect the thin bands through which the cut is to be made, and the toweling material is advanced from the detectors at each edge independently of the opposite edge so that the opposite ends of the thin band of the toweling material will be properly located at the cutter. The toweling is stretched across its length so as to remove the curvature of the thin band before the cut is made.

Although it has been recognized in the prior art that it is desirable to straighten the thin bands of toweling material before cutting through the toweling material, the prior art does not teach a method for aligning the thin bands of toweling material not only at the opposite edges of the toweling material but at several positions across the length of the toweling material in a simple, reliable and expedient manner.

SUMMARY OF THE INVENTION

Briefly described, the present invention comprises an automatic towel aligning, cutting and hemming system which is constructed and arranged to move a supply of sheet material, such as terry cloth toweling which includes bands of different character from the main body of the sheet material that extend across the length of the sheet material, to straighten the bands as the bands move to a cutting station so that an accurate cut can be made through the bands of the material. The toweling is cut through the thin bands of the toweling, and the cut segments are moved parallel to the cut ends and through a hemmer that folds and sews the cut ends.

The apparatus includes a feed roller and a presser foot assembly with a plurality of presser feet that are spring biased toward engagement with the feed roller. Each presser foot individually presses the toweling material into frictional engagement with the surface of the feed roll, so that rotation of the feed roll tends to pull the toweling material through the processing path. Each presser foot also extends beyond the feed roll toward the oncoming toweling material and includes a end portion that forms a depression in the plane of the toweling material. In the meantime, as the thin band of material is pulled by the feed roll and presser feet from the supply toward the cutting station a plurality of fingers of a gate assembly move into engagement with the thin band of toweling material. When the oncoming edge of the plush segment of toweling material reaches the fingers of the gate, each finger tends to stop the oncoming edge and therefore create tension in the portion of the toweling extending in a line from each finger to the feed roll. The tension in the toweling material tends to remove the depressions in the toweling material and lift each presser foot away from the feed roll, thereby relieving the moving force applied to the toweling material by the feed roll. Should the thin band of toweling material not be straight, the fingers of the gate will engage the oncoming edge of a plush segment of the material at different times, so that the presser feet will lift individually, not all at once away from the feed roll. This action tends to progressively relieve the pulling force applied by the feed roll and presser feet and to straighten the thin band of the toweling and stop the movement of the toweling at the cutting station.

After the toweling has been straightened and cut through its thin band, the cut segment of toweling is then moved from the transfer station along a path parallel to its cut edges, and the cut edges are folded over and sewn into a hem as the segment moves away from a transfer station.

Thus, it is an object of this invention to provide a sheet material aligning, cutting and hemming system wherein sheet material having bands extending across its length of a different character than the main body of the sheet material is advanced toward a cutting station and the bands approaching the cutting station are detected at several positions extending across the path, and in response to the detection the band is straightened by slowing the movement at those positions of the sheet material where a portion of the band leads another portion of the band.

Another object of this invention is to provide a sheet material aligning method and apparatus which straightens a band of the sheet material at a cutting station by engaging and pulling the sheet material at several positions across the sheet material, and terminating the pull on each portion of the sheet material in response to the detection of the band advancing to the correct position at the cutting station.

Another object of this invention is to provide a method and apparatus for cutting sheet material such as terry cloth towel having bands of different thicknesses extending across the material, which apparatus is reliable over prolonged operational periods to accurately cut the sheet material into lengths that correspond to the positions of the bands extending across the sheet material.

Another object of this invention is to provide a feeding and alignment mechanism which reliably moves sheet material such as terry cloth toweling having laterally extending bands through an operating station and which straightens the bands of the sheet material as the material moves into the operating station so that the sheet material can be accurately cut across its length or otherwise treated in the operating station with its bands straight.

Another object of this invention is to provide a mechanism for straightening the thin bands of terry cloth toweling by urging the toweling along its length at a plurality of positions arranged across the length of the toweling, and detecting at a plurality of positions arranged across the toweling the oncoming edge of the plush surface of the toweling, and in response to the detection at each position, terminating the urging of the toweling.

Other objects, features and advantages of the present invention will become apparent upon reading the following specification, when taken in conjunction with accompanying drawings.

BRIEF DESCRIPTIONS OF THE DRAWINGS

FIG. 2 is a detailed perspective illustration of the presser foot assembly as it engages the toweling material and urges the toweling material into engagement with the feed roll and as it forms a depression in the surface of the toweling material, and of the gate mechanism, showing a length of toweling material as a thin band of the material is advanced to the gate and toward the cutting station.

FIG. 3 is a side detail illustration of the presser foot assembly, feed roll and gate, showing the toweling material threaded between the feed roll and presser foot assembly with the toweling material spring urged by the presser feet into engagement with the feed roll and with the presser feet forming a depression in the toweling material between the feed roll and the gate.

DETAILED DESCRIPTION

Figure 1:
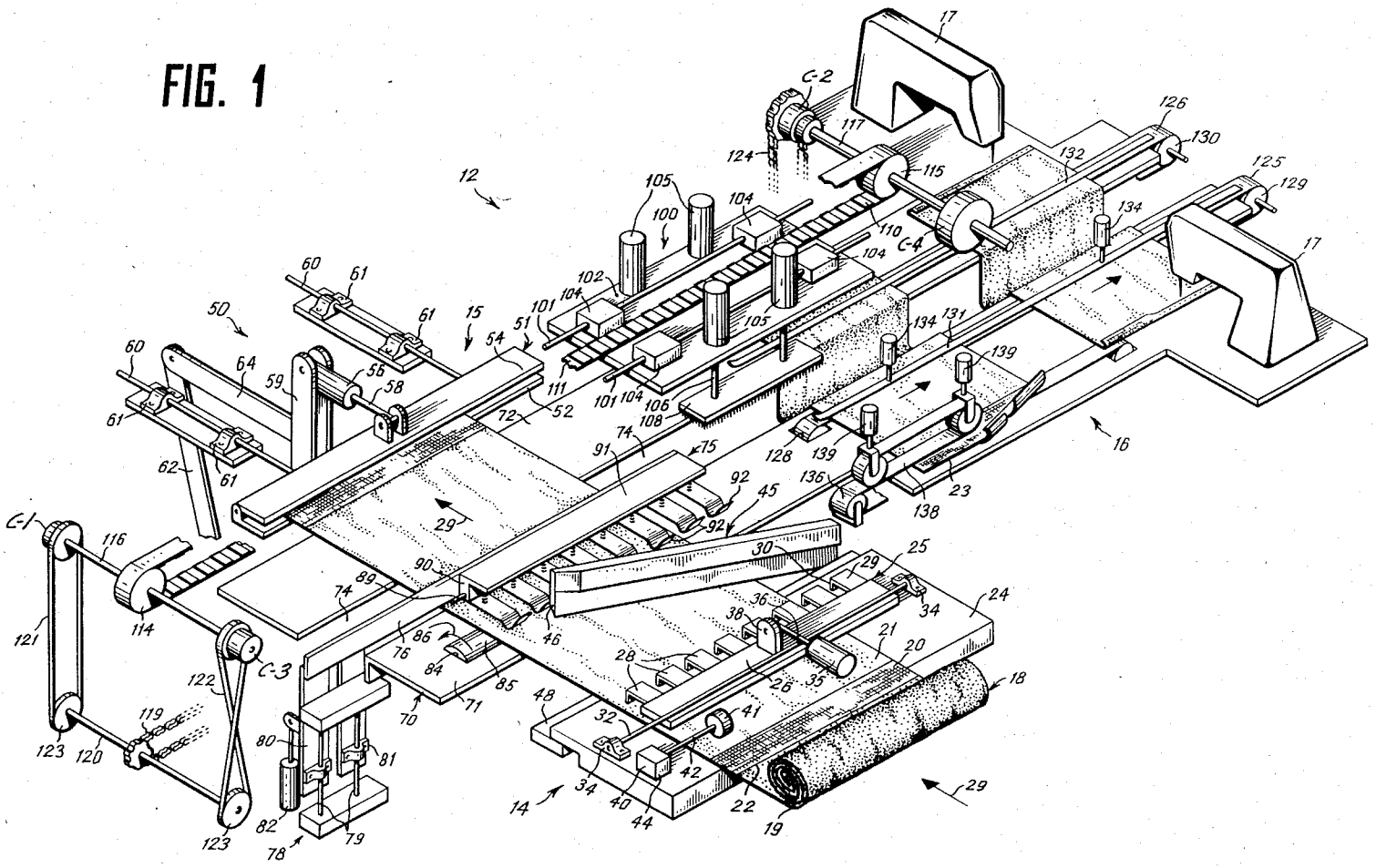
FIG. 1 is a perspective illustration of the automatic towel alignment, cutting and hemming apparatus, showing the operational elements of the apparatus without the various supports and the drive mechanisms.

Referring now in more detail to the drawings, in which like numerals indicate like parts throughout the several views, FIG. 1 illustrates the automatic towel aligning, cutting and hemming apparatus 12 which includes an aligning and cutting station 14, a transfer station 15, a hemming station 16 and sewing machines 17. A length of toweling material 18 or other sheet material is moved from a supply along a path through the aligning and cutting station 14 to the transfer station 15. The towel material is cut across its length at cutting station 14 and the cut segment in transfer station 15 is subsequently moved parallel to its cut ends through the hemming station 16 to sewing machines 17. The toweling material includes a plush terry cloth surface 19 and thin bands 20 extend laterally across the toweling. The cuts in the toweling material are to be made through the thin bands 20 equidistant between the leading and trailing edges 21 and 22 of the plush segments.

As the toweling moves through aligning and cutting station 14, it passes over work table 24 beneath gate 25. Gate 25 comprises a support block 26 with a plurality of L-shaped fingers 28 each of which includes a lateral span 29 and a vertical span 30. The fingers 28 are aligned with one another in a plurality of positions extending across the path of movement of the toweling. The lateral span of each finger 28 is mounted in the support block 26, and the lower edge 31 (FIG. 2) of the vertical span is positioned adjacent to the upper surface of the toweling 18. Support block 26 is mounted on axle 32 (FIG. 1) which is pivotably supported at its ends in bearing elements 34. Pneumatic cylinder 35 has its cylinder rod 36 attached to link 38 on the upper surface of support block 26, and operation of cylinder 35 causes the lower edges 31 of the L-shaped fingers to pivot about axle 32 so that they move toward and away from engagement with the upper surface of toweling material 18.

As illustrated in FIG. 1, band sensor 40 is also mounted on work table 24 and includes a roller 41 with its axle 42 extending from a housing 44. The axle 42 and roller 41 are spring biased toward engagement with the moving toweling material, and when a thin band 20 of a toweling material passes beneath roller 41, the roller moves downwardly and after the thin band passes from beneath the roller, the roller moves back up on to the upper surface of the plush segment of the terrycloth toweling. With this arrangement, the band sensor is able to sense the movement of a thin band 20 through the alignment and cutting station 14. If the toweling material is of the type that has bands of different dimensions, the sensor can be set so that it will ignore the small bands and detect only the larger bands. With this arrangement, it is only the larger bands that will be cut, in the manner hereinafter described.

Cutter 45 is positioned at the edge of work table 24 and is arranged to cut through the toweling material 18. Cutter 45 includes a movable blade 46 located above the path of travel of the toweling and a stationary element 48 below the path. The blade 46 moves by actuation of a clutch/brake motor and connecting arm (not shown) back and forth with a scissors like motion with respect to stationary element 48 so as to cut the toweling.

Stationary element 48 and work table 24 are arranged with a lost motion connection, whereby work table 24 and the gate 25 carried thereby can be moved toward and away from stationary element 48 of cutter 45. The reciprocation of work table 24 is caused by pneumatic cylinder 49 (FIGS. 7–9), and the position and movement of work table 24 is controlled by appropriate guides (not shown). With this arrangement, when a cut is made by cutter 45 through toweling material 18, and the cut edge of the toweling material is positioned at the edge of stationary element 48 of cutter 45, the work table 24 is moved along the path so that the cut edge of the portion of the toweling material extending back toward the supply is projected a short distance beyond the edge of stationary element 48, thereby presenting an edge of material that can be grasped and pulled on into transfer station 15.

Figure 6:
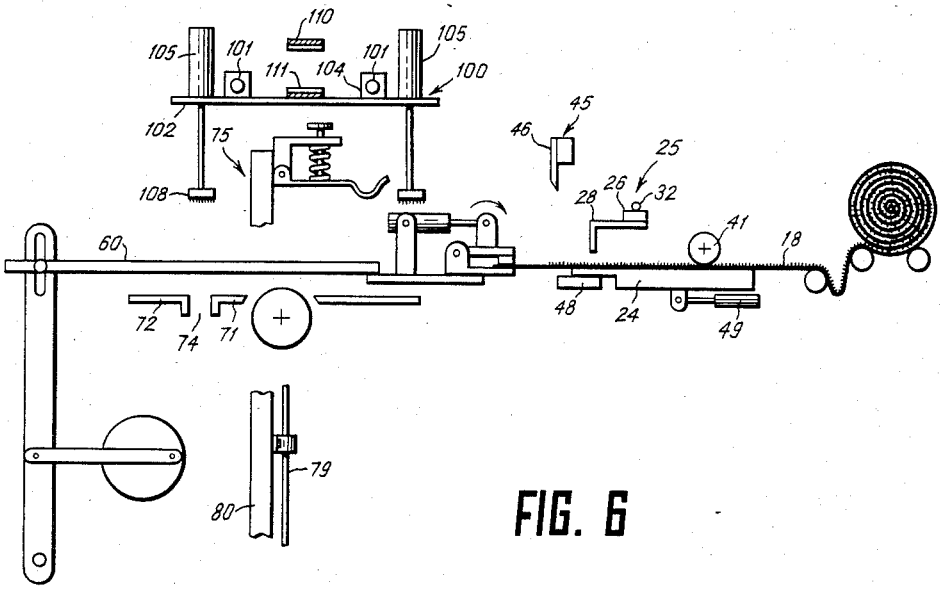
FIG. 6 is a side schematic illustration of the automatic towel aligning, cutting and hemming apparatus, showing the feed clamp in its position where it first engages the previously cut edge of the toweling.
Figure 7:
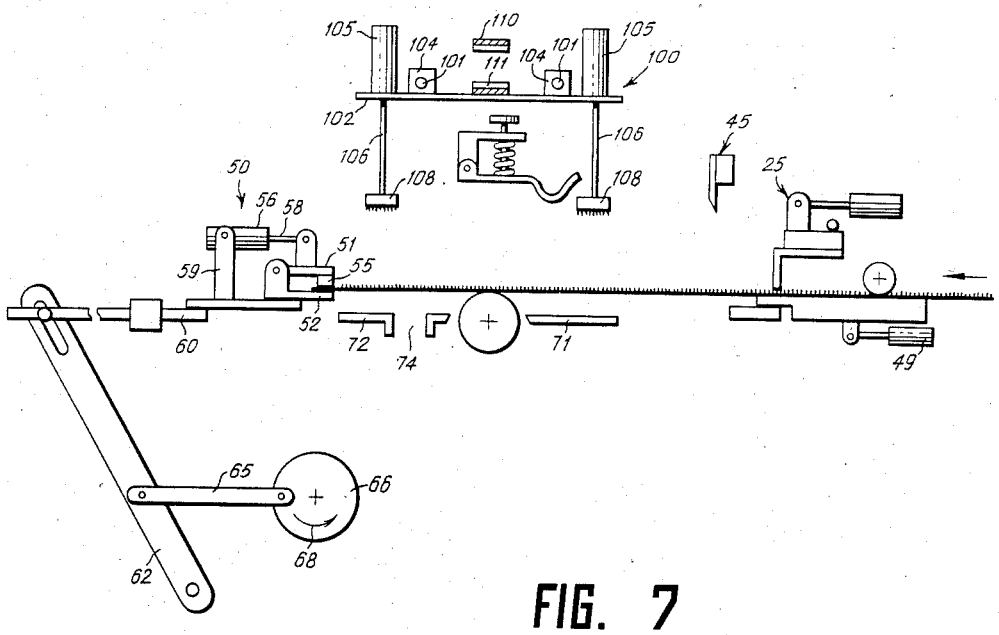
FIG. 7 is a side schematic illustration of the automatic towel aligning, cutting and hemming apparatus, similar to FIG. 6, but showing the feed clamp as it has drawn the previously cut edge of the toweling into position in the transfer station.

As illustrated in FIGS. 1, 6 and 7, draw out mechanism 50 is mounted on the other side of transfer station 15 from aligning and cutting station 14 and includes jaws 51 that are movable back and forth over the transfer station to grasp the previously cut edge portion of the toweling material and to pull the supply of material on into the transfer station. Jaws 51 include lower jaw 52 and upper jaw 54, with upper jaw 54 being pivotally mounted to lower jaw 52. A resilient strip of material 55 is applied to the inner surface of the upper jaw 54 so that the jaw makes frictional engagement with the toweling. Pneumatic cylinder 56 has its rod 58 attached to upper jaw 54, and cylinder 56 is supported by bracket 59 attached to lower jaw 52. With this arrangement, the jaws 51 open and close in response to the movement of the cylinder rod 58.

Lower jaw 52 of draw out mechanism 50 is supported on a pair of parallel, horizontally extending slide bars 60. Slide bars 60 are each mounted in bearings 61 and are supported by the framework of the apparatus, so that the slide bars pass axially through the bearings. Lever 62 is pivotally mounted to the frame work at its lower end, and its upper end is connected to one end of link 64. Link 64 is connected at its other end to lower jaw 52. As shown in FIGS. 6 and 7, crank arm 65 is connected at one of its ends to a mid-point of lever 62 and is connected at its other end to fly wheel 66. Fly wheel 66 is rotated about its center axis by a clutch-brake motor (not shown). With this arrangement, rotation of fly wheel 66 as indicated by arrow 68 causes jaws 51 of draw out mechanism 50 to reciprocate back and forth across transfer station 15, from immediately adjacent cutter 45 (FIG. 6) to a position where the jaws will have pulled the leading edge portion of the toweling material across the transfer station (FIG. 7). The jaws 51 are closed about the protruding edge portion of the previously cut toweling material, and then the jaws pull the toweling material to stretch it across the transfer station 15.

As illustrated in FIG. 1, a work table 70 extends from transfer station 15 through hemming station 16, with the work table 70 being formed in halves with one segment 71 locate adjacent aligning and cutting station 14 and the other segment 72 located further away from aligning and cutting station 14. A gap 74 is formed between work table segments 71 and 72.

As further illustrated in FIG. 1, presser foot assembly 75 is located over work table 70. Presser foot assembly 75 is mounted to cantilever support arm 76, and cantilever support arm 76 is mounted at one end to elevator assembly 78. Elevator assembly 78 comprises a pair of upright slide bars 79 and a movable support frame 80 slidably mounted to slide bar 79 by bearings 81. Pneumatic cylinder 82 functions to reciprocate support frame 80 on slide bars 79 so that presser foot assembly 75 can be raised and lowered with respect to the upper surface of work table 70.

Figure 8:
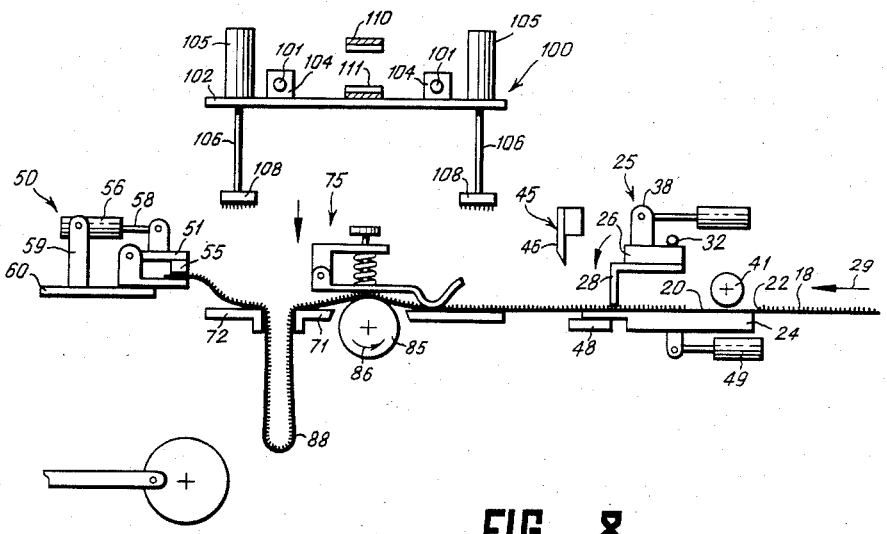
FIG. 8 is a side schematic illustration of the automatic towel aligning, cutting and hemming apparatus, similar to FIGS. 6 and 7, but illustrating the presser foot assembly in its lowered position whereby the thin band of toweling material is drawn on into the cutting station.
Figure 9:
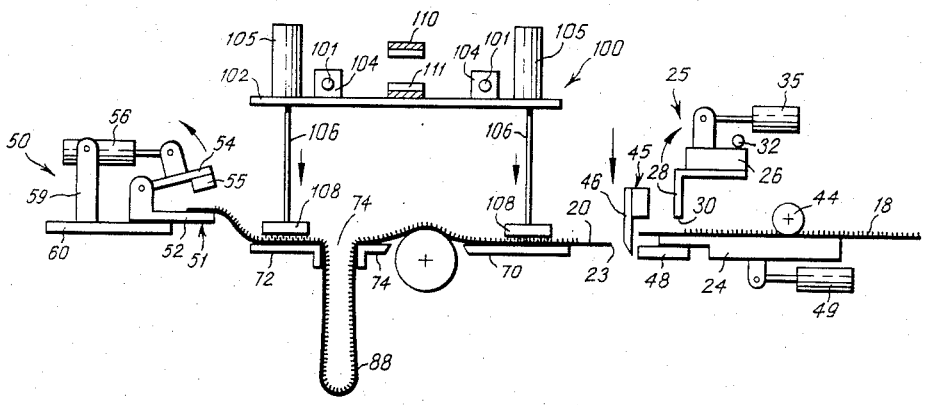
FIG. 9 is a side schematic illustration of the automatic towel aligning, cutting and hemming apparatus, similar to FIGS. 6–8, but illustrating the cut being made in the thin band of toweling material and the engagement of the cut segment of towel by the transfer trolley.

As illustrated in FIG. 1, segment 71 of work table 70 has a slot 84 formed therein, and feed roll 85 is positioned so that it protrudes upwardly through slot 84. Feed roll 85 is rotatable about its longitudinal axis in the direction as indicated by arrow 86 and is driven in that direction by motor M (FIG. 3) and its conventional belt and sheave connection to the feed roll, which functions as a means for rotating the feed roll about its longitudinal axis. Feed roll 85 and presser foot assembly 75 are positioned in vertical alignment with one another, so that when presser foot assembly 75 is moved down toward the plane of work table 70 it acts as a biasing means for urging the toweling material into engagement with feed roll 85, and the rotation of feed roll 85 will apply enough friction to the toweling material so that the feed roll acts as a feed means to draw the toweling material further onto work table 70. This tends to form a loop 88 in the toweling material on the other side of the feed roll that protrudes down into the gap 74 between the segments 71 and 72 of the work table 70 (FIGS. 8 and 9).

Figure 5:
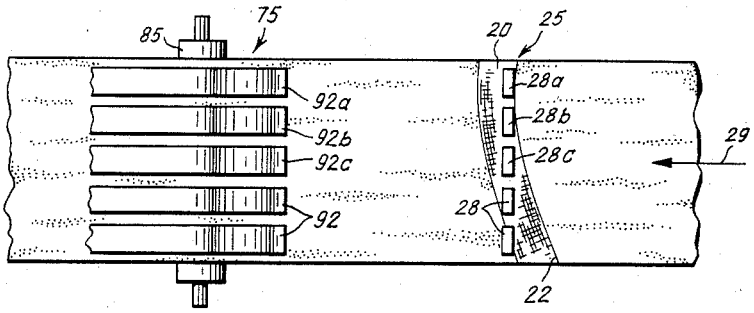
FIG. 5 is a schematic plan view of the presser foot assembly and the fingers of the gate, demonstrating how a thin band of the toweling material might approach and be engaged by the fingers of the gate.

As illustrated in FIGS. 1, 2 and 5, the presser foot assembly 75 comprises a support frame having a laterally-extending axle 89 extending through a pair of side frame elements 90 and an upper spring plate 91. A plurality of presser feet 92 are pivotably mounted at one end portion to axle 89 and extend laterally out from axle 89 beneath upper spring plate 91. A floating pin 94 is connected at its lower end portion to each presser foot 92 and extends up through an opening formed through spring plate 91. A coil compression spring 95 surrounds each floating pin 94 between a presser foot 92 and the upper spring plate 91 and tends to spring-bias its presser foot 92 downwardly away from spring plate 91 until the cap 96 of the floating pin engages the spring plate. The distal end 98 of each presser foot 92 is approximately U-shaped.

The presser foot assembly 75 is arranged with respect to feed roll 85 so that the flat portion 99 of each presser foot 92 is located over feed roll 85 and is spring-biased toward engagement with feed roll 85 when the presser foot assembly is in its lowered position. The U-shaped distal end portion 98 of each presser foot is positioned laterally away from the feed roll 85 toward gate 25 and is spring-biased downwardly into engagement with the toweling material (FIGS. 3 and 4) and tends to form a depression in the toweling material (FIG. 3). As illustrated in FIG. 3, when there is little tension in the toweling material 18 extending from gate 25 to feed roll 85, the presser feet 92 will be urged downwardly by coil compression springs 95 so that the flat portions 99 of the presser feet urge the toweling material into frictional engagement with feed roll 85, whereby the feed roll will pull the toweling material from gate 25 on into the gap 72 of the work table. However, if there is tension in the toweling material 18 sufficient to remove the slack in the toweling, the presser feet 98 will be lifted by the tension in the toweling (FIG. 4) so that the flat portions 99 of the presser feet will not press the toweling material into frictional engagement with the feed roll 85, whereupon no feeding of the toweling material will be caused by the feed roll.

Figure 4:
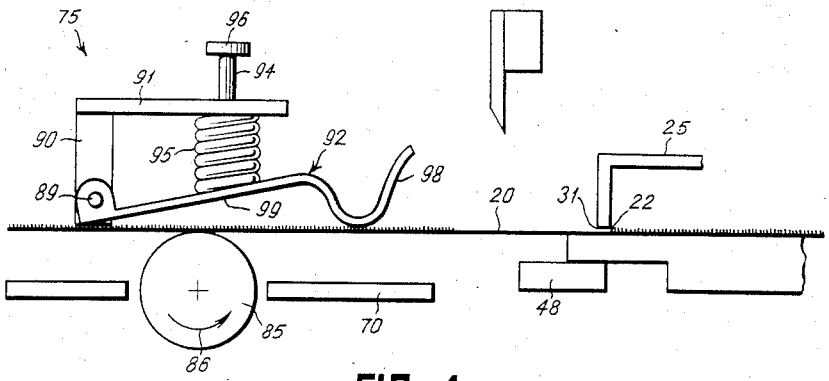
FIG. 4 is a side detail illustration similar to FIG. 3, showing the presser foot assembly, feed roll and gate, but showing how one of the fingers of the gate tends to stop the oncoming edge of the plush portion of the toweling material so as to stretch the toweling material from the gate to the feed roll and how the presser foot is lifted by the towel away from engagement against the feed roll.

As illustrated in FIGS. 2 and 5, there is one presser foot 92 in the presser foot assembly 75 for each of the L-shaped fingers 28 of the gate 25, and each presser foot 92 is aligned with a finger 28. When gate 25 is pivoted to its down position so that the lower edges 31 of the fingers 28 engage the thin band 20 formed in the toweling, and when the presser foot assembly 25 has been moved to its lowered position so that its presser feet 92 engage the toweling and urge the toweling into frictional contact with the feed roll 85, the feed roll will draw the toweling through the gate and feed the toweling to the gap 74 in the work table until the fingers detect the oncoming edge 22 of the plush segment of toweling. If the relatively thin band 20 in the toweling is not straight so that one portion of the band leads another portion, the leading portion of the oncoming edge 22 of the plush segment of the toweling will reach and therefore become detected by its L-shaped finger before the other trailing edge portions of the plush segment reach and become detected by their L-shaped fingers. For example, FIG. 5 illustrates finger 28A as having already engaged and therefore detected the oncoming edge of the plush segment of the toweling while the remaining fingers 28B, 28C, etc. have not yet been engaged by the oncoming edge 22. Therefore, finger 28A of gate 25 will tend to stop the movement of the portion of the oncoming edge that it engages, while the remaining portion of the oncoming edge is uninhibited. This tends to form tension in the toweling that extends between L-shaped finger 28A and its corresponding presser foot 92A, while similar tension is not created in the portions of the toweling extending between the other fingers 28B, 28C, etc. and their corresponding presser feet 92B, 92C, etc. Therefore, the span of the toweling between finger 28A and presser foot 92A will become taut as the feed roll continues to rotate, and eventually the presser foot 92A will move from its position as illustrated in FIG. 3 to the position as illustrated in FIG. 4, where the tension in that stretch of the toweling lifts the presser foot away from feed roll 85. Therefore, the stretch of toweling between finger 28A and presser foot 92A will no longer be pulled by feed roll 85, whereas the remaining portions of the toweling will continue to be pulled on into gate 25. As the L-shaped fingers of the gate 25 engage and therefore detect the oncoming edge of the plush segment of the toweling at positions across the path of movement of the toweling that are aligned with the positions of the presser feet 92, a similar result is generated, whereby each finger tends to stop the movement of the towel while the feed roll continues to pull on the towel, until the span of the toweling between the finger and its aligned presser foot becomes taut and lifts the presser foot, to terminate the pulling action by the feed roll. In this manner, the oncoming edge of the plush segment of the toweling will be properly aligned at the gate 25. When the material is to resume its movement the entire gate will be tilted upwardly away from the surface of the toweling by pneumatic cylinder 35, thereby releasing the toweling.

It will be noted from FIGS. 3 and 4 that the relatively small leading edge of the plush surface of the toweling presents only a small surface against which the fingers can engage; however, since the toweling is double-faced, the fingers 25 tend to push the thin band against the surface of the work table 24, and the following double-faced plush surfaces form a relatively large ledge against which the fingers work. Moreover, the presser foot assembly 75 functions to magnify the effect of the relatively small oncoming edge of the plush segment of the toweling, in that the toweling lifts from its slack position to its taut position through a distance that is much greater than the height of the plush surface of the toweling. This assists in lifting the flat portion of each presser foot away from the feed roll 85.

Transfer trolley 100 is mounted on a pair of parallel, horizontal slide bars 101 that extend from over transfer station 15 toward hemming station 16. Transfer trolley 100 comprises a support plate 102, slide blocks 104 mounted to the upper surface of support plate 102, with the slide blocks surrounding the slide bars 101 and supporting the plate from the slide bars. Four pneumatic cylinders 105 are mounted to support plate 102, with the cylinder rods 106 protruding downwardly through the support plate toward work table 70. A foot element 108 is mounted to the lower end of each cylinder rod 106. Timing belt 110 has its lower flight 111 attached to the upper surface of support plate 102 of transfer trolley 100. Timing belt 110 extend about sheaves 114 and 115, and sheaves 114 and 115 are mounted on drive axles 116 and 117, respectively. Drive axles 116 and 117 each have clutches mounted thereon, with clutches C-1 and C-3 mounted on axle 116 and with clutches C-2 and C-4 mounted on drive axle 117. Drive chain 119 is driven by a motor (not shown), and rotates lower drive axle 120. Drive belts 121 and 122 extend from sheaves 123 mounted on lower drive axle 120 and about the sheaves of the clutch brakes C-1 and C-3 on the upper drive axle 116, with one belt 122 being criss-crossed so as to drive the upper drive axle 116 in the opposite direction. The motor that drives chain 119 operates through a gear box to drive the chain at a high velocity, so that upper drive axle 116 operates at a high velocity to move timing belt at a high rate of speed, approximately 450 feet per minute.

Clutch C-2 at the drive axle 117 is driven by chain 124, and chain 124 is driven by the motor (not shown) that drives sewing machines 17. When drive axle 117 is rotated by clutch C-2, it is driven at a relatively slow speed, and causes timing belt 110 to move at approximately 50 feet per minute. Clutch C-4, which is mounted to the opposite end of drive axle 117, functions as a brake and simply stops the rotation of drive axle 117 and timing belt 110.

The arrangement of clutches C-1, C-2, C-3 and C-4 which are mounted to drive axles 116 and 117 are such that when clutch C-1 is engaged, the lower flight of timing belt 110 and transfer trolley 100 are driven at a relatively high speed from above transfer station 15 toward hemming station 16. As the transfer trolley approaches hemming station 16, clutch C-1 is disengaged and clutch C-2 engages. This causes the timing belt 110 and transfer trolley 100 to continue to move in the same direction but to be driven at the slower speed that corresponds to the speed of operation of the sewing machines 17. When the transfer trolley has been driven its full length toward sewing machines 17, clutch C-2 disengages and clutch C-3 engages. Clutch C-3 then moves the timing belt 110 and transfer trolley 100 in the reverse direction at a high velocity until the transfer trolley approaches its start position, whereupon clutch C-3 disengages and clutch C-4 engages. Clutch C-4 functions as a brake to stop the movement of the timing belt and transfer trolley.

When transfer trolley 100 is to be driven from left to right in FIG. 1, from transfer station 15 toward hemming station 16, the upright cylinders 105 carried by the transfer trolley are operated to move their feet 108 downwardly toward the segment of the previously cut towel present on the work table, so that the feet engage the towel. The subsequent movement of the transfer trolley tends to cause the feet to drag the towel on the work table from the transfer station, parallel to the cut edges of the towel, on into the hemming station 16. When the transfer trolley has moved the towel into the hemming station, the feet 108 are retracted by the cylinders 105 and the transfer trolley is moved back to its start position.

The hemming station 16 includes sewing machines 17 located on opposite sides of the gap 74 of the work table 70, a pair of carrier belts 125 and 126 which have upper flights that move upwardly through openings such as opening 128 in work table segment 71 and move through the hemming station and about a sheave 129 and 130, and then return beneath the work table segments. Presser bars 131 and 132 are positioned over carrier belts 125 and 126 and are movable toward and away from the carrier belts by means of pneumatic cylinders, such as cylinders 134 for presser bar 131. When the transfer trolley 100 approaches carrier belts 125 and 126, the cylinders 134 lift the presser bars 131 and 132 so that the oncoming towel segment carried by the transfer trolley moves onto the carrier belts at a high rate of speed. When the transfer trolley slows down, the cylinders 134 lower the presser bars 131 and 132, so that the relatively smooth presser bars urge the oncoming towel into frictional contact with the carrier belts 125 and 126. Transfer belts 125 and 126 move at a linear velocity compatible with the operation of sewing machines 17.

Hemmer belts 136 are positioned adjacent the opposite edges of work table segments 71 and 72 at hemming station 16. Each hemmer belt 136 (only one being shown) carries the cut edge of the towel segment through the hemming station. An upper clamping belt 138 is located over each hemmer belt 136. The upper clamping belt is an idler belt and is driven by frictional contact with the lower hemmer belt. The upper clamping belt 138 is movable up and down by pneumatic cylinders 139. When the transfer trolley 100 moves a towel segment onto the hemmer belts 136, the upper clamping belts 138 are lifted away from the lower hemmer belt until the towel is at least partially received on the lower hemmer belt, whereupon the upper clamping belts are lowered so as to make positive contact with the previously cut edge portion 23 of the towel segment. Thus, the cut edges of the towel segment are positively controlled as they move on into the sewing machine 17.

The hemmer belts 136 are the type that can be folded over upon themselves as they fold and form the hem of the toweling material. Examples of hemmers suitable for use with this system are described in more detail in U.S. Pat. Nos. 3,772,948 and 3,906,878.

Figure 10:
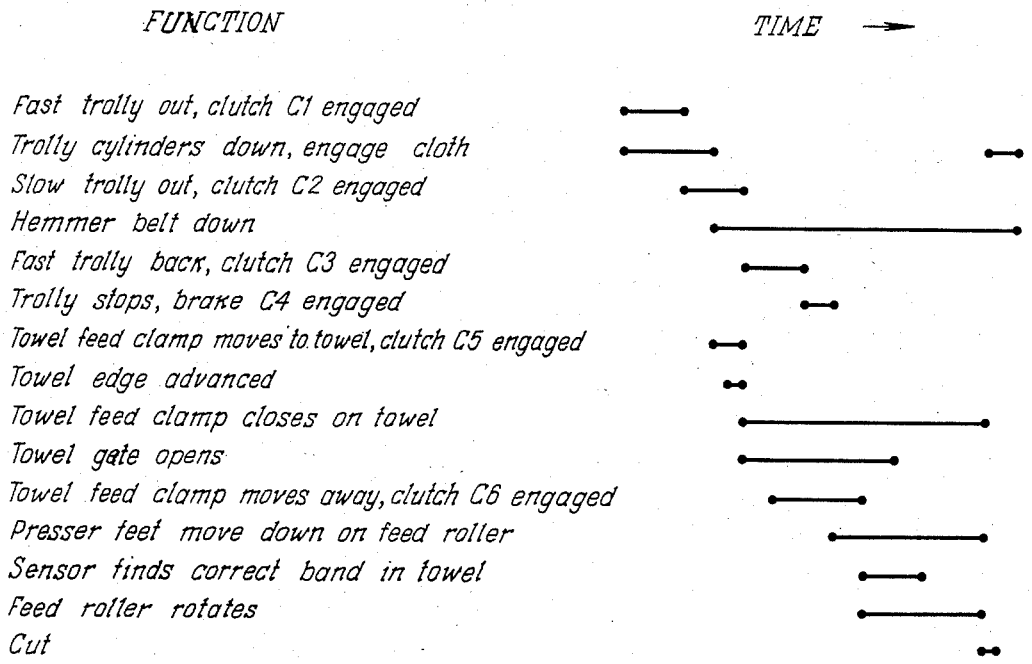
FIG. 10 is a time diagram which illustrates the function of the various elements of the automatic towel aligning, cutting and hemming system.

FIG. 10 is a timing diagram of the system, showing the approximate sequence and duration of operation of the various clutches, cylinders and other features of the system.

OPERATION

When the automatic towel aligning, cutting and hemming system is to begin a cycle of operation, a towel has just been cut, and the transfer trolley 100 has its cylinders 105 distended so that each of the cylinders engage the previously cut towel segment. The clutch C-1 is engaged and functions to move the transfer trolley rapidly from the transfer station 15 on into the hemming station 16 causing the cut towel segment to slide along the work table. The loop 88 in the cut segment tends to ride along in slot 74 which extends entirely from transfer station 15 on through hemming station 16. As the transfer trolley approaches the hemming station, clutch C-1 disengages and clutch C-2 engages, causing the transfer trolley to move at a slower speed that is compatible with the operation of sewing machines 17. The towel segment is then moved onto carrier belts 125 and 126 and onto hemmer belts 135 and 136, and presser bars move down into engagement with the towel segment and upper clamping belts 138 similarly move down into clamping engagement with the towel segment. After the presser bars 131–132 and upper clamping belts 138 have engaged the towel segment, the feet of the transfer trolley are retracted upwardly, clutch C-2 disengages and clutch C-3 engages, causing the transfer trolley to move rapidly back to its start position. As the transfer trolley reaches its start position, clutch C-3 disengages and clutch C-4 engages, thereby braking the trolley to its start position. In the meantime, the cut segment of toweling material is carried on through the hemming station, its previously cut ends are folded over and sewn together by sewing machines 17.

In the meantime, draw out mechanism 50 will begin its movement across transfer station 15 just as soon as transfer trolley has cleared the transfer station. Draw out mechanism 50 moves from the position illustrated in FIG. 7 toward cutter 45 with its jaws 51 in their open position. Just as the jaws 51 reach the previously cut edge of the supply of toweling material, cylinder 49 of work table 24 causes the work table to move toward the oncoming jaws. This is illustrated in FIG. 6. This pushes the previously cut edge of the toweling material beyond the stationary element 48 of the cutter 45, thereby presenting and edge of the toweling material that can be grasped by the jaws. When the jaws reach the toweling material, the jaws clench the previously cut edge portion of the toweling material, and the draw out mechanism then begins to move in the opposite direction to draw the supply of toweling material out into the transfer station 15.

As illustrated in FIG. 7, when the jaws reach their start position, the toweling material will have been drawn from the supply through the gate 25 through the cutter 45, across the transfer station 15 so that the previously cut edge of the toweling material extends slightly beyond the far edge of the work table 72. Now that the draw out mechanism 50 has cleared the work table (FIG. 7), presser foot assembly 75 is lowered until its presser feet press the toweling down into engagement with the feed roll 85 (FIG. 8). As the feed roll rotates, it draws more toweling material from a supply through gate 25 and cutter 45 with a loop 88 being formed in the toweling material. When the roller 41 of the band sensor 40 detects a thin band in the toweling material, cylinder 35 of gate 25 will cause the gate to be lowered and its fingers 28 will engage the thin band. As the oncoming edge of the plush segment of the toweling material engages the fingers 28 of the gate 25, tension will be applied to the segment of toweling material extending between the gate 25 and feed roll 85, whereupon the distal U-shaped end portions 98 of the presser feet 92 function as relief means to raise the presser feet and relieve the force applied by the presser feet against the feed roll and the presser feet 92 will be raised from their positions illustrated in FIG. 3 to their positions as illustrated in FIG. 4. As illustrated in FIG. 5, if one portion of the thin band 20 leads another portion, the fingers 28 of the gate 25 will engage the oncoming edge of the plush surface of the toweling at different times and the corresponding presser feet will lift individually at different times away from the feed roll, causing earlier release of the pulling force on that portion of the toweling that is too far ahead, which results in the band 20 being straightened at the gate 25. Thus, the fingers 28 of gate 25 function as detecting means positioned up the path from the feed roll for detecting the movement of the band at intervals across the toweling as the band approaches the feed roll.

Once the band has been straightened and positioned at the gate, cutting blade 45 is pivoted downwardly to cut across the toweling. The relative positions of the cutter 45 and the gate 25 are adjustable so that the cut will be made equal distance between the trailing and leading edges of the plush segments of the towel, directly through the thin band 20 of the toweling material. In the meantime, the feet 108 of transfer trolley will have been lowered into engagement with the segment of toweling extending across the transfer station and the jaws 51 will have been opened. This places the now cut segment of toweling in control of the transfer trolley 100 and the cycle is repeated.

While this invention has been described in connection with terrycloth toweling, it should be understood by those skilled in the art that various other types of sheet material can be handled by the system as may be desired. Also, while the towel alignment mechanism has been disclosed in combination with a towel cutter, the alignment mechanism can be used in combination with various other equipment, such as drying equipment and dyeing equipment.

While this invention has been described in detail with particular reference to a preferred embodiment thereof, it will be understood that variations and modifications can be effected within the spirit and scope of the invention as described hereinbefore and as defined in the appended claims.

I claim:

1. Apparatus for straightening the laterally extending bands of a supply of terry cloth toweling as the toweling moves along its length through a predetermined path comprising feed means extending across the path, biasing means for urging the toweling toward frictional engagement with said feed means at intervals across the toweling whereby the toweling engages the feed means and the feed means pulls the toweling along the path, detecting means positioned up the path from the feed means for detecting the movement of a laterally extending band of the toweling at intervals across the toweling as the band approaches the feed means, and relief means responsive to the detection of a band by the detecting means for relieving the force of the biasing means at the interval across the toweling which corresponds to the interval where the detection of the band is made.

2. The apparatus of claim 1 and wherein said feed means comprises a feed roll extending across the path and means for rotating said roll about its longitudinal axis.

3. The apparatus of claim 1 and wherein said biasing means comprises: a plurality of presser elements arranged in equally spaced relationship across the path of the toweling and means for urging each presser element toward engagement with said feed means.

4. The apparatus of claim 1 and wherein said detecting means comprises a plurality of fingers movable into engagement with the toweling for engaging and restraining the movement of the edge portion of the plush surface of the toweling adjacent a band of the toweling without a plush surface.

5. Apparatus for straightening laterally extending thin bands of terry cloth toweling or the like as the toweling is drawn along its length by a rotating feed roll comprising a presser foot assembly for urging the toweling into engagement with said rotating feed roll whereby the engagement of the rotating feed roll and the toweling advances the toweling, said presser foot assembly comprising a support frame, a plurality of presser feet arranged in side-by-side relationship and each independently movably mounted to said support frame, each said presser foot including a first portion for engaging and urging the toweling into contact with the feed roll and a second portion for positioning to one side of the feed roll and shaped to form a recess in the toweling, gate means positioned in the path of the toweling as the toweling moves toward the feed roll, said gate means including a plurality of fingers arranged in side-by-side relationship and each finger being aligned along the path of the toweling with a presser foot, and means for urging the fingers of said gate means into contact with the toweling to engage and restrain the movement of any on-coming edge of plush section of the toweling and form tension in the toweling extending from the finger to its aligned presser foot, whereby stretching the toweling between a finger and its aligned presser foot tends to remove the portion of the recess of the toweling between the finger and its aligned presser foot and lift at least one presser foot and move the presser foot away from the feed roll.

6. The presser foot assembly of claim 5 and further including spring means for urging each said presser foot toward engagement with the feed roll.

7. The presser foot assembly of claim 5 and further including means for moving said support frame toward and away from the feed roll whereby material feed means can be moved between the feed roll and the presser feet.

8. A method of straightening laterally extending bands that extend across a length of sheet material comprising the steps of urging the sheet material with a plurality of engaging surfaces at a plurality of positions spaced across the sheet material into engagement with the surface of a drive roll having a longitudinal axis extending across the length of the sheet material, and rotating the drive roll about its longitudinal axis whereby the drive roll pulls the sheet material along its length through a predetermined path, simultaneously detecting the movement of a laterally extending band in the sheet material at a plurality of positions each aligned along the path with a position where the sheet material is pulled, and reducing the pulling of the sheet material at each position across the band which is aligned with a position where the band movement is detected.

9. The method of claim 8 and wherein the sheet material comprises terry cloth and the bands comprise the absence of the plush surface of the sheet material and wherein the step of simultaneously detecting the movement of a laterally extending band in the sheet material at a plurality of positions comprises engaging an oncoming edge of the plush surface of the sheet material with a plurality of gate elements which retard the movement of the plush surface, and wherein the step of reducing the pulling of the sheet material comprises pulling the sheet material until the span of sheet material extending between the drive roll and the gate element which engages the plush surface is taut, and lifting the engaging surface aligned with the gate element away from the drive roll in response to the segment of sheet material becoming taut.

10. A method of straightening the laterally extending thin bands of a length of terry cloth toweling and the like comprising urging a ply of the toweling with a plurality of presser feet elements arranged at intervals across the length of the toweling into engagement with the surface of a rotary feed roll having its axis of rotation extending across the length of the toweling and rotating the feed roll to move the toweling along its length, restraining the movement of the oncoming edge of the plush surface of the toweling moving toward the feed roll at positions across the toweling aligned with the presser feet to stretch the length of toweling extending between each position across the toweling and its aligned presser foot, and moving a presser foot away from the toweling in response to the stretching of the toweling at the presser foot.

11. The method of claim 10 and wherein the step of urging the ply of toweling with a plurality of presser feet into engagement with a feed roll also includes engaging with each presser foot the span of toweling extending between the feed roll and the position of the restraining of the oncoming edge of the plush surface to form a recess in the span of toweling between the feed roll and the fingers, whereby the stretching of the toweling between the feed roll and the position of restraining the oncoming edge of the plush surface tends to remove the recess in the toweling and moves the fingers away from the feed roll.

12. The method of claim 10 and further including the steps of cutting across the thin bands of the toweling after the thin bands have been straightened to form cut segments of toweling, moving the cut segments parallel to their cut edges, and simultaneously hemming both cut edges as the cut segments move.

13. The method of claim 10 and wherein the step of restraining the oncoming edge of the plush surface of the toweling comprises urging a plurality of finger members with substantially equal force into engagement with the thin bands of the toweling so that an oncoming edge of plush toweling moves into engagement with and is held from movement by the fingers.

14. A method of processing a length of terry cloth toweling and the like having segments of plush terry cloth separated by laterally extending thin bands, comprising advancing the toweling along its length through a cutting station and across a feed roll, urging the span of toweling with a plurality of presser feet into engagement with the feed roll at positions spaced across the toweling whereby rotation of the feed roll tends to draw the toweling through the cutting station, restraining the movement of an oncoming edge of a plush segment of terry cloth at positions across the toweling that are aligned with the positions of the presser feet to cause tension in the toweling, and individually moving each presser foot away from the feed roll in response to tension in the toweling which is aligned with the presser foot.

* * * * *